United States Patent [19]

Donley et al.

[11] 4,171,393

[45] Oct. 16, 1979

[54] ELECTROLESS PLATING METHOD REQUIRING NO REDUCING AGENT IN THE PLATING BATH

[75] Inventors: Samuel W. Donley; Peter N. Bacel, both of Rochester, N.Y.

[73] Assignee: Eastman Kodak Company, Rochester, N.Y.

[21] Appl. No.: 808,225

[22] Filed: Jun. 20, 1977

[51] Int. Cl.[2] ..... B05D 1/18; C23C 3/00

[52] U.S. Cl. ..... 427/354; 427/216; 427/217; 427/436

[58] Field of Search ..... 75/208 R, 212; 427/436, 427/328, 247, 216, 217, 354; 428/550, 570, 566; 106/1.27

[56] References Cited

U.S. PATENT DOCUMENTS

| | | | |
|---|---|---|---|
| 2,532,283 | 12/1950 | Brenner et al. | 117/50 |
| 2,762,723 | 9/1956 | Talmey et al. | 117/130 |
| 2,935,425 | 5/1960 | Gutzeit et al. | 117/130 |
| 2,999,770 | 9/1961 | Gutzeit | 117/130 |
| 3,121,644 | 2/1964 | Gutzeit et al. | 117/130 |
| 3,148,072 | 9/1964 | West et al. | 106/1 |
| 3,202,529 | 8/1965 | Dunlap, Jr. et al. | 117/50 |
| 3,264,199 | 8/1966 | Fassell, Jr. et al. | 204/38 |
| 3,338,741 | 8/1967 | Katz | 117/160 |

FOREIGN PATENT DOCUMENTS

| | | | |
|---|---|---|---|
| 562046 | of 1944 | United Kingdom | 427/436 |

*Primary Examiner*—Evan K. Lawrence
*Attorney, Agent, or Firm*—William T. French

[57] ABSTRACT

An improved method for the electroless plating of metals is accomplished by a sustainable direct metal-metal ion displacement reaction on porous metal surfaces. It is applicable whenever the plating metal is more electronegative than the porous metal surface on which it is to be plated. The porous metal must be a catalyst for the displacement reaction, and the pores of the porous metal surface must be large enough to enable plating solution to wet the internal surfaces of the pores and to enable cations of the porous metal to diffuse into the plating solution, but the pores must not be so large as to allow plating solution to circulate freely into them. The method comprises immersing an article having a porous metal surface in an alkaline aqueous solution containing cations of the plating metal. No chemical reducing agent for the metal cations is required in the plating bath.

15 Claims, No Drawings

ELECTROLESS PLATING METHOD REQUIRING NO REDUCING AGENT IN THE PLATING BATH

BACKGROUND OF THE INVENTION

1. Field of the Invention

The present invention relates to methods of plating metals onto other metals. More particularly it concerns electroless plating methods, i.e., those methods in which no external electric current is applied to initiate or sustain the plating reaction. The present invention relates to methods of plating metals onto more electropositive porous metal surfaces by chemical reducing of cations of the metal to be plated by atoms of the metal being plated. This method requires no chemical reducing agent in addition to the porous metal surface itself.

2. Description of the Related Art

Electroless methods of depositing metals on other metals are well known. They are disclosed for example in U.S. Pat. Nos. 2,532,283; 2,762,723; 2,935,425; 2,999,770; 3,338,741; 3,202,529; 3,121,644; 3,264,199; and 3,148,072. These methods are self-sustaining and require no application of the external current needed in other electroplating techniques. The known methods normally involve immersing the metal substrate to be plated in a solution containing cations of the metal to be deposited. The methods may also employ complexing agents to keep the cations in solution until plated, ingredients to adjust pH, and a means for heating the solution to an optimum temperature for the particular reactions being employed. The plating reaction is normally catalyzed at first by the metal substrate being plated and, at a later point in the process, by the deposited metal itself.

To sustain the plating process after depositing a few atomic thicknesses of the plating metal, the known electroless plating processes require a chemical reducing agent to reduce the cations of the metal to be deposited. For example, electroless nickel plating processes normally employ sodium hypophosphite as the chemical reducing agent for the nickel cations. However, the hypophosphite process is inconvenient for a number of reasons. Much of the hypophosphite is wasted because it reacts with water, rather than the metal cations. This reaction results in the formation of gaseous hydrogen, which causes unwanted bubbling in the plating solution. Such bubbling can sometimes become uncontrollable. In the process of depositing nickel on iron using a hypophosphite reducing agent, solutions must be formulated in large, dilute volumes, because the solubilities of nickel and iron phosphites are very low. Even when large volumes are used some nickel and iron phosphite residues form, and the solution must be discarded after each use. This, in itself, is a problem, because simple disposal of phosphorous-containing solutions into public sewer systems is now prohibited by environmental regulations, and processes for reclaiming the phosphite are difficult at best. Also, the utilization of chemical reducing agents inevitably results in a metal deposit that contains some of the elements of the reducing agent in addition to the plating metal itself. In some applications, this is very undesirable and prevents practical utilization of the electroless plating process.

Therefore, it would be desirable if a sustainable electroless plating processes could be carried out without the addition of any external reducing agent. When the metal to be deposited is more electronegative (has a lower oxidation potential) than the metal substrate on which it is to be deposited, the metal substrate itself can serve as the reducing agent for the cations of the plating metal. However, it has been thought that such a process could not be carried out to any useful extent, because after a few atomic thicknesses of the plating metal are deposited, the rate of diffusion of metal substrate ions out into the solution becomes essentially zero, thus effectively cutting off the source of reducing agent for the metal cations. This is described, for example, in, M. Lelental, "Catalysis in Nickel Electroless Plating" *J. Electrochem. Soc.*, 122(4), pp. 486-90 (April 1975). Lelental has indicated that for all practical purposes the maximum thickness of a layer of a plating metal that could be deposited on a more electropositive metal substrate by ion exchange with the substrate beneath the layers already plated is $7.5\times10^{-7}$ cm., because at that point the reaction rate would drop to essentially zero. Accordingly, it has been assumed that such a process would not provide a useful method of electroless plating, because generally a plating thickness of at least $2.5\times10^{-6}$ cm. is necessary to provide a deposit sufficient to cover the underlying surface and more often a plating thickness of about $2.5\times10^{-4}$ cm. is desired.

SUMMARY OF THE INVENTION

The present invention provides an improved method for sustained electroless plating on a metal surface that unexpectedly does not require the use of a chemical reducing agent in the plating solution. Any porous metal surface can be used as a substrate providing that such metal substrate has a higher oxidation potential than the plating metal, that the surface of the metal substrate is sufficiently porous to allow metal cations from the substrate to diffuse into the plating solution at a rate sufficient to sustain the deposition of plating metal on the substrate's outer surface and that the pores are small enough not to allow free flow of solution through the pores.

In accord with the present invention, a method for sustained electroless plating with a plating solution comprising cations of a plating metal and having no chemical reducing agent comprises:

immersing a porous metal substrate into the plating solution, said metal substrate having a higher oxidation potential than the plating metal; and depositing a layer of the plating metal on the external surface of the substrate, said layer having a thickness greater than about $7.5\times10^{-7}$ cm.

The term "external surface" as used herein means the outer surface area of the substrate not including the surface area within the pores.

DETAILED DESCRIPTION OF THE INVENTION

The method of the present invention makes use of a simple displacement reaction between the cations of the metal to be plated and the atoms of the metal substrate's porous surface onto which the plating metal is to be deposited. The reaction results in the cations of the plating metal being reduced to neutral atoms of the plating metal. These atoms adhere to the metal substrate's porous surface or to the surface of a layer of the plating metal which has already been deposited on these areas. At the same time neutral atoms of the metal substrate are converted to cations which escape into the plating solution through the pores in the surface of the metal substrate. In order for this plating reaction to be electroless, that is, self-sustaining and requiring no application of an external electric current, it is necessary that the metal substrate itself serve as the reducing agent for the cations of the plating metal. Therefore, in the present invention, the metal substrate must have a higher oxidation potential in the electromotive force series than the plating metal, i.e., the plating metal must be more electronegative than the metal substrate.

Another requirement of the present method is that the cations of the metal substrate that are formed by the displacement reaction be able to freely diffuse into the plating solution. If the metal substrate's surface were not porous, virtually none of these cations would be able to escape into the solution after a few atomic layers of the plating metal had been deposited, and the plating reaction would stop. Lelental, supra, has shown that virtually no substrate-metal ions would be able to diffuse through a deposited layer of plating metal thicker than about $7.5\times10^{-7}$ cm. Therefore, for all practical purposes, in accord with the teachings of the prior art, it would not be feasible to achieve a plated-layer thickness greater than about $7.5\times10^{-7}$ cm on a non-porous metal surface by a simple displacement reaction.

The present method unexpectedly allows a layer much thicker than about $7.5\times10^{-7}$ cm to be plated in a reasonable amount of time by using a metal having a porous surface for a substrate. The substrate must be sufficiently porous to allow cations of the metal substrate that form at internal surface areas to diffuse through the pores and into the plating solution at a sufficient rate so that plating can occur on the external surfaces of the substrate at a reasonable rate.

As used herein the term "reasonable rate" means that the rate of deposition of plating metal on the external surface areas of the porous substrate is not less than 50% of the reaction rate in a typical electroless plating process using the same plating solution except containing a reducing agent.

The term "reasonable time" as used herein refers to the length of time required to deposit the desired thickness of plating metal when the deposition proceeds at a reasonable rate.

The size of the pores is an important factor. The pores must be large enough for the plating solution to wet the internal surfaces of the pores and to enable substrate cations to diffuse out of the pores into the bulk of the plating solution. However, the pores cannot be so large that fresh plating solution can circulate freely into the pores. If this happens, the inside surface of the pores would become plated just the same as the external surfaces and the source of substrate cations would be eliminated thus quenching the plating reaction.

Metal substrates for use in the present invention should be chosen with these factors in mind. However, since pores are not easily measured and the degree of porosity is difficult to determine, it is recommended that the following simple test be used to determine whether a surface will plate in accord with the teachings of the present invention. The simple test comprises treating a test sample of the metal substrate with a plating solution comprising cations of the desired plating metal and no chemical reducing agent. If the plating reaction is sustained beyond the plating of a few atomic layers of plating metal, the metal substrate is suitable for use in the present invention. The term, porous metal surface, as used herein is meant to define metal surfaces that will sustain a plating reaction without the necessity for a chemical reducing agent in the plating solution as determined by the simple test described above.

In a preferred embodiment of the present invention, metals such as copper and nickel are plated on the external surfaces of a porous iron powder. Hoeganaes EH iron powder has been found to be a metal substrate having a porous surface suitable for use in the plating method of the present invention. Hoeganaes EH iron powder (often called sponge iron) is a rough-surface, porous iron formed by the reduction of iron ore or other iron oxides at temperatures less than the fusion point of iron. The Hoeganaes EH iron powder used in the examples described below is in the form of irregular particles varying from about 80 to about 120 mesh in the U.S. Standard Seive Series. This corresponds to particle diameters from about 177 microns to about 125 microns. The pores in these particles vary in size with most of the pores in the range of from about 10 microns to about 20 microns. About one half of the total surface area of these particles is internal, i.e., within the pores or enclosed, and the other half is external surface area (or visible area). Hoeganaes EH iron powder may be obtained from the Hoeganaes Corporation, Riverton, N.J. The porous configuration of the surface of such particles was found to be sufficient to allow their use in the method of the present invention.

Like other electroless plating methods, the present method is autocatalytic, that is, the porous metal surface and the layers of deposited plating metal will catalyze the displacement reaction. Accordingly, the present method cannot employ, as the porous-surface, metal substrate, such metals as lead, tin, zinc, cadmium, antimony, arsenic, and molybdenum. These metals are anticatalysts for the present method and will interfere with the plating reaction.

The present method comprises immersing an article having a porous metal surface in an electroless plating solution. This solution contains cations of the plating metal, obtained by dissolving any readily available, soluble salt of the plating metal in water. In some applications of the present method, these cations and product cations must be held in solution by the use of appropriate complexing agents. Such agents are well known in the art and are chosen according to the particular plating-metal cations to be used. For example, when nickel cations are used, appropriate complexing agents may include such compounds as sodium citrate, ammonium hydroxide, ammonium chloride, ammonium sulfate, hydroxyacetic acid, and the like. One useful complexing agent, among others, for copper cations is the disodium salt of ethylenediamine tetraacetic acid ($Na_2EDTA$).

Additional ingredients may be necessary to keep the pH of the plating solution within an optimum range for the particular plating reaction to be effectively carried out. In one embodiment of the present invention, wherein nickel cations react with porous iron, the optimum pH range was found to be about 9 to 9.5 and ammonium hydroxide is used to maintain this pH. In another embodiment, the deposition of copper on a porous iron surface, sodium hydroxide or potassium hydroxide are present or are added stepwise during the reaction in order to adjust the pH to about 9 to 9.5 and maintain it at that level. Most well-known buffering agents can be used for this purpose and the use of such buffering agents is well known by those skilled in the art.

The electroless plating reation of the present invention is accomplished by controlling the temperature of the plating solution at a temperature effective for the particular plating reaction to take place. Each of the particular plating reactions may have an optimum temperature range at which it should be run to obtain best results. Such optimum temperature is known or easily determined by those skilled in the art. The plating solution is heated to this temperature before immersion of the article having a porous metal surface. In the examples below, the nickel-iron reaction takes placed best in a solution maintained at a temperature of about 90 to 95 degrees centrigrade, and the copper-iron reaction is initiated at room temperature but takes place much faster when the plating solution reaches a temperature of about 50 degrees centigrade. In the copper-iron reaction the solution temperature is allowed to rise once the reaction starts.

The particular complexing agents, buffering agents, pH control, and temperature useful for a given process are well known in the electroless plating art and can easily be selected by those skilled in the art.

Other procedures well known for use with electroless plating methods are equally applicable in the present method. These may comprise such steps as preparing the surface of the metal substrate by alkaline cleaning and acid pickling, blowing an inert gas, e.g., nitrogen, over the plating solution during reaction to prevent air oxidation of the metals, agitating the solution during the reaction, rinsing the plated product and drying the plated product.

The following examples are presented to further illustrate the method of the present invention.

EXAMPLE 1

Plating nickel on a porous iron surface.

| Ingredients | Amounts |
|---|---|
| Water | 3.5 l |
| $NiSO_4 . 5H_2O$ | 100 gm |
| Sodium citrate | 164 gm |
| $NH_4OH$ | 85 ml |
| Hoeganaes EH iron | 2 kg |

Except for the absence of sodium hypophosphite and the use of an iron substrate with a porous surface, the above ingredients and proportions are typical of those normally used in previously known electroless nickel-plating processes. All the ingredients except the iron were heated together in a large beaker with stirring. When the solution temperature reached 90 degrees centigrade, the iron was added. Nitrogen gas was blown over the solution surface to inhibit air oxidation. The temperature was maintained at 90 to 95 degrees centigrade, and the solution was stirred vigorously. The reaction was complete after 20 minutes, as evidenced by the change in solution color from deep blue to light green. The plated iron was rinsed five times with water and four times with methanol and dried in air. The nickel-plated iron was analyzed and found to be 1% nickel by weight. This corresponds to a plated-layer thickness of about $9.8 \times 10^{-7}$ cm. No nickel was left in the solution, but iron was present in the solution in the same molar concentration as Ni originally, indicating the reaction was a direct displacement of iron by nickel.

EXAMPLE 2

Plating copper on a porous iron surface.

| Ingredients | Amounts |
|---|---|
| Water | 3 l |

-continued

| Ingredients | Amounts |
|---|---|
| $CuSO_4 . 5H_2O$ | 25 gm |
| $Na_2EDTA . 2H_2O$ | 50 gm |
| KOH | 15 gm |
| Hoeganaes EH iron | 500 gm |

The water, copper sulfate, and EDTA were heated together. The potassium hydroxide was added during heating to bring the pH to 9. When the solution temperature reached 50 degrees centigrade, the iron particles were added with vigorous agitation. A color change from deep blue to light greenish-blue indicated the reaction was complete after one minute. The copper-plated iron was rinsed five times with water and four times with methanol and dried in air. Analysis showed the product to be 0.98% copper by weight.

EXAMPLE 3

Plating of copper on a non-porous iron surface.

This example is included to show the inapplicability of the present method to metal substrates having non-porous surfaces. Like Hoeganaes EH iron, Whittaker iron particles range in size from a diameter of about 125 microns to about 177 microns, but Whittaker iron particles are spherical, smooth-surfaced, and non-porous.

| Ingredients | Amounts |
|---|---|
| Water | 3 l |
| $CuSO_4 . 5H_2O$ | 25 gm |
| $Na_2EDTA . 2H_2O$ | 50 gm |
| KOH | 15 gm |
| Whittaker iron | 300 gm |

The steps followed were the same as in Example 2 above, except that the reaction was not complete after one minute. In fact the solution was maintained for one hour, during which the pH was constantly adjusted to between 9 and 9.5. The product was removed and analyzed and found to be only 0.1% copper by weight. This corresponds to a plated-layer thickness of only about $6 \times 10^{-8}$ cm or less than 5 atomic layers. If all the copper had been plated, as in the method using Hoeganaes EH iron, the product would have been 2% copper by weight. The result in this experiment indicates that the reaction rate became virtually zero after a few atomic layers of copper were plated.

EXAMPLE 4

Plating of copper on a porous iron surface.

This example illustrates the capability of the present method to deposit very thick layers of plating metal in a reasonable amount of time.

| Ingredients | Amounts |
|---|---|
| Water | 3.2 l |
| $CuSO_4 . 5H_2O$ | 25 gm |
| $Na_2EDTA . 2H_2O$ | 100 gm |
| NaOH | 18 gm |
| Hoeganaes EH iron | 75 gm |

The water, copper sulfate, and EDTA were heated together. The sodium hydroxide was added stepwise during the heating and reaction steps to maintain the pH at about 9 to 9.5. When the solution temperature reached 50 degrees centigrade, the porous iron particles were added with vigorous agitation. The reaction was complete after 55 minutes. The product was rinsed with water and immersed in a fresh plating solution, identical to the first, for a total of two hours. The temperature of the solution was allowed to rise during the reaction and reached 80 degrees centigrade by the time the reaction was complete. The copper-plated iron surfaces were rinsed five times with water and four times with methanol and allowed to dry in air. Upon analysis, the product was found to be 13.7% copper by weight. This was calculated to be a layer with an average thickness of about $1.4\times10^{-5}$ cm of copper plated on the surface of the porous iron. This layer is about 18 times thicker than the prior art taught could be plated without the use of a chemical reducing agent in the plating solution, and about 225 times thicker than the layer that could actually be plated on non-porous Whittaker iron powder (Example 3) by the present method.

EXAMPLE 5

In order to demonstrate the application of this invention to various types of porous surfaces cylinders (1 cm in diameter by 0.5 cm high) were hot pressed from Whittaker iron particles, i.e. solid, spherical iron particles having a particle size distribution from about 125 m to about 177 m as used in Example 3. The cylinders were made by cold pressing under 100 lb. pressure, heating to 800° C. under vacuum and holding at 800° C. for 10 minutes, and then applying 1000 lb pressure at 800° C. under vacuum for 10 minutes.

Cross sections of the cylinders were examined under microscope and found to be a solid, nonporous mass throughout the bulk to within two or three particle diameters of the outside surface. Near the surface there was a porous shell at least 100 m thick in which spaces (or pores) could be seen between the particles.

The cylinders were plated in a copper bath as described in Example 3 having no chemical reducing agent. The outer surface of the cylinder was bright yellow. X-ray fluorescence analysis showed that the outer surface of the cylinder contained copper to a depth of at least 20 mg/m$^2$ (max. limit of detection of this analysis).

The outer surface of one of the cylinders was removed using a fine emory wheel. Examination of the pores or internal iron surfaces showed no yellow color from copper deposition but appeared musty. This demonstrated that no plating occurred in the pores and all plating occurred on the external surface of the cylinder. Although the non-porous Whittaker iron particles could not be plated without a reducing agent as demonstrated by Example 3, an article having a porous surface made by hot-pressing the same particles can be plated without reducing agent.

This invention has been described in detail with particular reference to certain preferred embodiments thereof, but it will be understood that variations and modifications can be effected within the spirit and scope of the invention.

What is claimed is:

1. A method for electroless plating on a porous metal surface, said method comprising immersing an article having a porous metal surface in an aqueous electroless plating solution comprising cations of a plating metal which is more electronegative than said porous metal to accomplish a sustained metal-metal ion displacement reaction, said aqueous electroless plating solution having an alkaline pH and being substantially free of any chemical reducing agent for said cations other than said porous metal; said porous metal being a catalyst for said displacement reaction; and the pores of said porous metal surface being large enough to enable the plating solution to wet the internal surfaces of said pores and to enable cations of said porous metal to diffuse into the plating solution, but not large enough to allow the plating solution to circulate freely into said pores.

2. The electroless plating method of claim 1, said method not requiring and not including a subsequent step of heating the metal-plated porous metal surface in order to achieve satisfactory adhesion between said plating metal and said porous metal surface.

3. A method for electroless plating on a porous metal surface, said method comprising immersing an article having a porous metal surface in an aqueous electroless plating solution comprising cations of a plating metal which is more electronegative than said porous metal, said electroless plating solution having a pH of at least about 9 and being substantially free of any chemical reducing agent for said cations other than said porous metal; said porous metal being a catalyst for said displacement reaction; the pores of said porous metal surface being large enough to enable the plating solution to wet the internal surfaces of said pores and to enable cations of said porous metal to diffuse into the plating solution, but not large enough to allow the plating solution to circulate freely into said pores; and said method being capable of depositing a layer of said plating metal having a thickness greater than $7.5\times10^{-7}$ centimeters on said porous metal surface.

4. A method for electroless plating as described in claim 3, wherein the aqueous electroless plating solution further comprises a complexing agent for keeping said cations in solution until plated and a buffering agent for stabilizing pH.

5. A method for electroless plating as described in claim 3, wherein the aqueous electroless plating solution further comprises a complexing agent for keeping said cations in solution until plated, and the method further comprises adding stepwise during the plating reaction an agent for adjusting pH.

6. A method for electroless plating as described in claim 4, said method further comprising maintaining the temperature of said aqueous electroless plating solution within a range effective for the reaction of said cations with said porous metal surface.

7. A method for electroless plating as described in claim 5, said method further comprising heating said aqueous electroless plating solution until it reaches a temperature effective for the reaction of said cations with said porous metal surface.

8. A method for electroless plating on a porous iron surface, said method comprising immersing an article having a porous iron surface in an aqueous electroless plating solution comprising cations of a plating metal which is more electronegative than iron, said aqueous electroless plating solution having a pH of at least about 9 and being substantially free of any chemical reducing agent for said cations other than said porous iron; the pores of said porous iron surface being large enough to enable the plating solution to wet the internal surfaces of said pores and to enable cations of said porous iron to diffuse into the plating solution, but not large enough to allow the plating solution to circulate freely into said pores; and said method being capable of depositing a layer of said plating metal having a thickness greater than $7.5\times10^{-7}$ centimeters on said porous iron surface.

9. A method for electroless plating as described in claim 8, wherein the plating metal is nickel.

10. A method for electroless plating as described in claim 8, wherein the plating metal is copper.

11. The method of claim 9 wherein the source of nickel cations in the aqueous electroless plating solution is nickel sulfate, and the aqueous electroless plating solution further comprises ammonium hydroxide and sodium citrate.

12. The method of claim 10 wherein the source of copper cations in the aqueous electroless plating solution is copper sulfate, and the aqueous electroless plating solution further comprises potassium hydroxide and the disodium salt of ethylenediamine tetraacetic acid.

13. The method of claim 10 wherein the source of copper cations in the aqueous electroless plating solution is copper sulfate, and the aqueous electroless plating solution further comprises sodium hydroxide and the disodium salt of ethylenediamine tetraacetic acid.

14. A method for the electroless plating of nickel on a porous iron surface, said method comprising the steps of:

(1) maintaining an aqueous electroless nickel-plating solution at a temperature effective for deposition of said nickel on said porous iron surface while stirring;
(2) immersing an article having a porous iron surface in the nickel-plating solution;
(3) blowing an inert gas over the solution to inhibit air oxidation of the porous iron surface;
(4) stirring until the desired amount of nickel is deposited on the porous iron surface;
(5) removing the article having a nickel-plated iron surface from the plating solution;
(6) rinsing the nickel-plated iron surface; and
(7) drying the nickel-plated iron surface in air; said aqueous electroless nickel-plating solution comprising nickel cations, a complexing agent for nickel cations, and a pH-buffering agent; said aqueous electroless nickel-plating solution having a pH of from about 9.0 to about 9.5 and being substantially free of any chemical reducing agent for nickel cations other than said porous iron; the pores of said porous iron surface being large enough to enable the nickel-plating solution to wet the internal surfaces of said pores and to enable cations of said porous iron to diffuse into the nickel-plating solution, but not large enough to allow the nickel-plating solution to circulate freely into said pores; and said method being capable of depositing a layer of nickel having a thickness greater than $7.5\times10^{-7}$ centimeters on the external areas of said porous iron surface.

15. A method for the electroless plating of copper on a porous iron surface, said method comprising the steps of:

(1) heating an aqueous electroless copper-plating solution comprising copper cations and a complexing agent for copper cations with stirring until the temperature of the solution reaches about 50 degrees centigrade;
(2) adding a pH-adjusting agent to the solution during the heating step to bring the solution to a pH of from about 9.0 to about 9.5;
(3) immersing an article having a porous iron surface in the plating solution;
(4) agitating the plating solution until the desired amount of copper is deposited on the porous iron surface;
(5) removing the article having a copper-plated iron surface from the solution;
(6) rinsing the copper-plated iron surface;
(7) drying the copper-plated iron surface in air; said aqueous electroless copper-plating solution being substantially free of any chemical reducing agent for copper cations other than said porous iron; the pores of said porous iron surface being large enough to enable the copper-plating solution to wet the internal surfaces of said pores and to enable cations of said porous iron to diffuse into the copper-plating solution, but not large enough to allow the copper-plating solution to circulate freely into said pores; and said method being capable of depositing a layer of copper having a thickness greater than $7.5\times10^{-7}$ centimeters on said porous iron surface.

* * * * *